US005600863A

United States Patent [19]

Curran

[11] Patent Number: 5,600,863

[45] Date of Patent: Feb. 11, 1997

[54] PIPE SCRAPER ASSEMBLY

[76] Inventor: Ed. Curran, 830 S. Northlake Dr., Hollywood, Fla. 33019

[21] Appl. No.: 581,311

[22] Filed: Dec. 29, 1995

Related U.S. Application Data

[63] Continuation of Ser. No. 531,939, Sep. 21, 1995, Pat. No. 5,528,790.

[51] Int. Cl.[6] ..... B08B 9/04

[52] U.S. Cl. ..... 15/104.061

[58] Field of Search ..... 15/3.5, 3.51, 104.061, 15/104.063, 104.05, 104.16

[56] References Cited

U.S. PATENT DOCUMENTS

| | | | |
|---|---|---|---|
| 412,125 | 10/1889 | Schelpers | 15/104.16 |
| 2,263,774 | 11/1941 | Heltzel . | |
| 2,392,144 | 1/1946 | Hall | 15/104.061 |
| 2,399,544 | 4/1946 | Danner . | |
| 2,740,480 | 4/1956 | Cox | 15/104.05 |
| 3,484,886 | 12/1969 | Girard | 15/104.061 |
| 3,619,844 | 11/1971 | Collins et al. . | |
| 3,939,519 | 2/1976 | Muirhead . | |
| 4,726,089 | 2/1988 | Knapp . | |
| 4,937,907 | 7/1990 | Antal . | |
| 5,127,125 | 7/1992 | Skibowski . | |
| 5,265,303 | 11/1993 | Neff . | |

FOREIGN PATENT DOCUMENTS

| | | | |
|---|---|---|---|
| 17342 | 8/1913 | France | 15/104.16 |
| 726602 | 3/1936 | France | 15/104.16 |
| 1244196 | 9/1960 | France | 15/104.061 |
| 1310672 | 10/1962 | France | 15/104.16 |
| 47350 | 5/1889 | Germany | 15/104.16 |
| 801904 | 10/1978 | U.S.S.R. . | |
| 0801904 | 2/1981 | U.S.S.R. | 15/104.061 |
| 23934 | 3/1907 | United Kingdom | 15/104.16 |
| 835922 | 5/1960 | United Kingdom | 15/104.16 |
| 859032 | 1/1961 | United Kingdom | 15/104.061 |
| 975067 | 11/1964 | United Kingdom | 15/104.16 |

*Primary Examiner*—David Scherbel
*Assistant Examiner*—Randalle Chin
*Attorney, Agent, or Firm*—Herbert L. Lerner; Laurence A. Greenberg

[57] ABSTRACT

A pipe scraper assembly is forced through condenser pipe interiors for scraping residue off the inner wall surface. The scraper assembly is formed with a cylindrical body with a head and a tail end. Several mutually spaced apart rings are coaxially and rotatably supported on the cylindrical body between the head and the tail end. The diameter of the rings corresponds to the inner diameter of the pipe to be scraped. The rings have a radial cut formed therein which extends obliquely relative to the longitudinal axis of the cylindrical body.

4 Claims, 1 Drawing Sheet

PIPE SCRAPER ASSEMBLY

This is a continuation of application Ser. No. 08/531,939, filed Sep. 21, 1995, now U.S. Pat. No. 5,528,790.

BACKGROUND OF THE INVENTION

1. Field of the Invention

The invention relates to so-called pigs, i.e. scraper assemblies which are forced through heat exchanger tubes for scraping deposits from the inner wall surface thereof. The pigs of this invention are mainly used for cleaning condenser tubes in power plants and other large heat exchange systems with a multiplicity of tubes.

Condenser systems have hundreds, and even thousands, of parallel pipes which must be regularly cleaned of sedimentation on the inner wall surfaces. A properly cleaned tube wall assures proper heat exchange. One of the conventional cleaning methods includes loading a bullet-like pig scraper into the tube at a header thereof and forcing the pig through the tube with water pressure. Cylindrical vanes of the pig thereby scrape deposits from the inner tube walls.

2. Description of the Related Art

One such scraper is disclosed in U.S. Pat. No. 3,619,844 to Collins et al. The pipeline scraper of that prior art disclosure is formed with a central body and two pairs of disks. The disks of each pair are mutually engaged so as to prevent a rotation thereof.

A similar scraper is found in U.S. Pat. No. 3,939,519 to Muirhead which is provided with up to nine mutually spaced apart disks. The disks are provided with radially oriented cutouts. In one embodiment the cutouts of each disk are angularly aligned and in another embodiment they are angularly offset relative to the respectively adjacent disk. Furthermore, the bullet body is formed with a longitudinal opening, which facilitates a certain amount of pressure equalization in front of and behind the scraper pig.

A bullet shaped scraper assembly with three annular rings is disclosed in U.S. Pat. No. 4,937,907 to Antal. The rings are cut in one position so as to allow them to circumferentially contract and expand, depending on the tube diameter and the deposit obstructions the scraper encounters. A stop is provided in each groove in which the rings are supported. The stops secure the rings against free rotation, while only negligibly restrict the contraction of the rings.

The prior art scraper assemblies with the compression or pressure-exchange slots have in common that each of the scraper disks does not in fact scrape the entire wall surface, i.e. the scraping circumference is less than the required 360°. Accordingly, a certain amount of deposit is left on the tube wall by each disk. Furthermore, the prior art pigs are not easily located if they become stuck in the tube.

SUMMARY OF THE INVENTION

It is accordingly an object of the invention to provide a pipe scraper assembly, which overcomes the hereinaforementioned disadvantages of the heretofore-known devices of this general type and which allows full circumference scraping with each disk and which are more easily located than prior art scrapers.

With the foregoing and other objects in view there is provided, in accordance with the invention, a pipe scraper assembly for scraping pipe interiors with a given inner diameter, the pipe scraper comprising:

a substantially cylindrical body with a head and a tail end, a plurality of mutually spaced apart rings coaxially and rotatably supported on the cylindrical body between the head and the tail end;

the rings having a diameter substantially corresponding to a given inner diameter of the pipe to be scraped; and each of the rings having a radial compression slot formed therein extending obliquely relative to a longitudinal axis of the cylindrical body.

In accordance with another feature of the invention, the rings are rotatably supported on the cylindrical body about the longitudinal axis of the cylindrical body.

In a preferred embodiment, there are provided three rings equidistantly disposed relative to one another.

In accordance with an added feature of the invention, the rings have a plurality of axially oriented bores formed therethrough.

In accordance with again another feature of the invention, the cylindrical body comprises a central axle bolt having the tail end integrally formed thereon and having a thread formed opposite the tail end, spacer sleeves coaxially supported on the axle bolt between the rings and spacing the rings apart, and the head being in the form of a bullet head with an internal thread matched to the thread on the axle bolt.

In accordance with again a further feature of the invention, the scraper pig, e.g. the rings, the head, the tail end, and the spacer sleeves, are made from high-visibility fluorescent material. In other words, the scraper pig glows in the dark. This alleviates one of-the major problems associated with multi-tube condenser cleansing operations. A considerable number of scraper pigs are lost in that they become stuck in the tubes. Quite often, this may add up to hundreds of pigs in a condenser with several thousand tubes which, in turn leads to an efficiency drop of ten or more percent.

In accordance with a concomitant feature of the invention, the scraper disks have rifling grooves formed on a peripheral surface thereof.

Other features which are considered as characteristic for the invention are set forth in the appended claims.

Although the invention is illustrated and described herein as embodied in a pipe scraper assembly, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
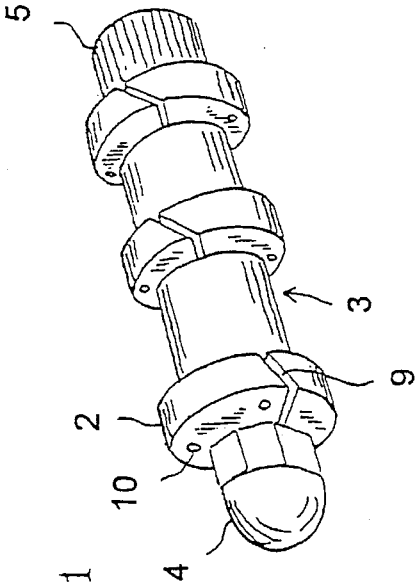
FIG. 1 is a perspective view of an assembled scraper pig according to the invention.

Referring now to the figures of the drawing in detail and first, particularly, to FIG. 1 thereof, there is seen a scraper assembly 1 according to the invention. The embodiment shown has three rings 2, and a substantially cylindrical body formed of a barrel 3, a head 4, and a tail end 5.

Figure 3:
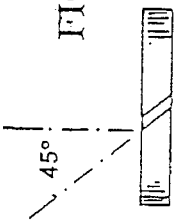
FIG. 3 is a side elevational view of a scraper disk.
Figure 4:
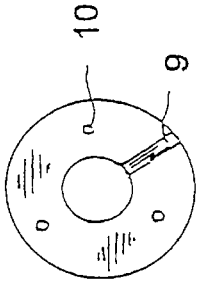
FIG. 4 is a plan view thereof.
Figure 5:
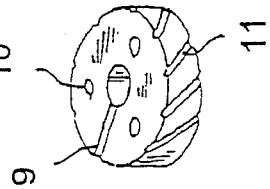
FIG. 5 is a perspective view of an alternative scraper disk embodiment.
Figure 2:
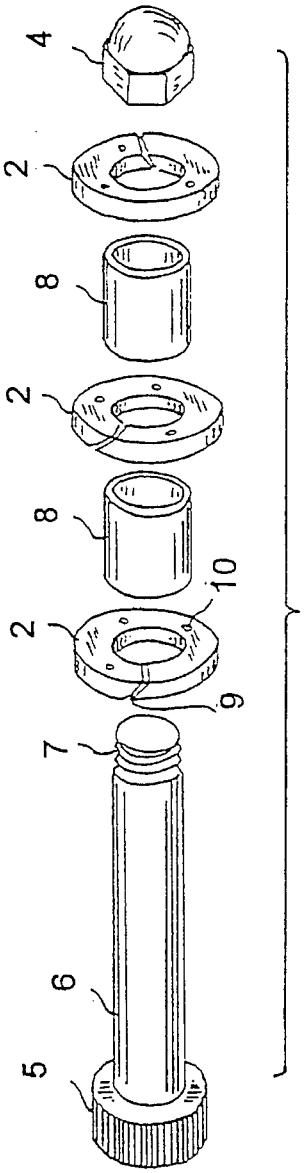
FIG. 2 is an exploded view thereof.

As illustrated in FIG. 2, the scraper assembly of this invention is modularly built from several components. The tail end 5 is integrally formed with a central axle bolt 6.

The axle bolt 6 is provided with a thread 7 at the end which is opposite from the tail end 5. The thread 7 corresponds to a female thread inside the head 4.

Three rings 2 and two spacer sleeves 8 are alternatingly slipped onto the bolt 6 and the head 4 is screwed onto the thread 7.

The dimensions of the individual components must be carefully chosen such that a minimum spacing between the tail end 5 and the head 4 (when it is fully threaded onto the bolt 6 and bottomed out) is no less than a thickness of all of the rings 2 and the sleeves 8 combined. This assures that the rings can freely rotate about the longitudinal axis of the bolt 6.

A radial compression slot 9 is formed in each ring 2. The slot 9 forms a spacing distance which allows slight compression and expansion of the ring 2. Additionally, axial flushing openings 10 are formed so as to equalize the partial pressures in front of and behind the scraper as it is forced through the heat exchanger tubes. Furthermore, the openings 10 aid in the lubrication and they cause a reduction in the velocity of the scraper pigs. Additional information with regard to such pressure equalization considerations is found in the afore-mentioned patent to Antal, for instance.

The radial compression slot 9 is formed at an angle relative to the axial direction. The preferred angle is approximately 45°. Besides the advantage that the scraper rings 2 always cover all of the 360° of tube wall surface, the rifling cut leads to rifled rotation in some cases, i.e. a turbo cleaning effect. The rifling adds to the cleaning efficiency of the scraper assembly. It is possible to add additional rifling grooves 11 about the periphery of the rings 2.

The head 4, as illustrated, is preferably rounded and it is formed of a relatively soft polymer. This reduces possible coating damage inside the condenser tube.

One of the major problems associated with multi-tube condenser cleansing operations is the fact that a large number of scraper pigs are lost in that they become stuck in the tubes. Quite often, this may add up to hundreds of pigs in a condenser with several thousand tubes which, in turn leads to an efficiency drop of ten or more percent. This problem is alleviated, in accordance with the invention, in that the scraper pigs (or at least the rings 2) are made from high-visibility fluorescent color material. Such scraper pigs, which glow in the dark, are much more easily found.

I claim:

1. A pipe scraper plug assembly for scraping a pipe interior with a given inner diameter, the pipe scraper plug assembly comprising:

a substantially cylindrical body with a head and a tail end, a plurality of mutually spaced apart, substantially equidiametric rings coaxially and freely rotatably supported on said cylindrical body between said head and said tail end;

said cylindrical body and said rings together forming the pipe scraper plug assembly which is adapted to be propelled through a pipe;

said rings each having a diameter substantially corresponding to a given inner diameter of the pipe to be scraped and further wherein said rings have a plurality of axially oriented bores formed therethrough; and said cylindrical body comprising a central axle bolt having said tail end integrally formed thereon and having a thread formed opposite said tail end, spacer sleeves coaxially supported on said axle bolt between said rings and spacing said rings apart, and said head being in the form of a bullet head with an internal thread matched to said thread on said axle bolt.

2. The pipe scraper according to claim 1, wherein said rings are rotatably supported about the longitudinal axis of said cylindrical body.

3. The pipe scraper according to claim 1, wherein said plurality of rings are three rings substantially equidistantly disposed relative to one another.

4. The pipe scraper according to claim 1, wherein each of said rings has rifling grooves formed on a peripheral surface thereof.

* * * * *